US007278669B2

(12) United States Patent
Nakajima

(10) Patent No.: US 7,278,669 B2
(45) Date of Patent: Oct. 9, 2007

(54) BOTTOM DISCHARGE CONTAINER

(75) Inventor: Ritsuo Nakajima, Kimitsu (JP)

(73) Assignees: Ritsuo Nakajima, Nobuo Shoji (JP); Shinichi Hori (JP)

( * ) Notice: Subject to any disclaimer, the term of this patent is extended or adjusted under 35 U.S.C. 154(b) by 75 days.

(21) Appl. No.: 10/534,442

(22) PCT Filed: Oct. 21, 2003

(86) PCT No.: PCT/JP03/13426

§ 371 (c)(1),
(2), (4) Date: Jul. 11, 2005

(87) PCT Pub. No.: WO2004/045989

PCT Pub. Date: Jun. 3, 2004

(65) Prior Publication Data

US 2006/0071490 A1 Apr. 6, 2006

(30) Foreign Application Priority Data

Nov. 15, 2002 (JP) ..... 2002-332744

(51) Int. Cl.
*B65D 51/00* (2006.01)
*E04G 21/02* (2006.01)

(52) U.S. Cl. ..... 294/68.24; 294/68.1

(58) Field of Classification Search ..... 294/68.2, 294/68.21, 68.22, 68.23, 68.24; 414/403, 414/411, 414
See application file for complete search history.

(56) References Cited

U.S. PATENT DOCUMENTS

| | | | | |
|---|---|---|---|---|
| 2,856,223 | A * | 10/1958 | Weaver | 294/68.24 |
| 3,339,964 | A * | 9/1967 | Morey et al. | 294/68.24 |
| 3,414,312 | A * | 12/1968 | Garlinghouse | 294/68.24 |
| 6,863,324 | B1 * | 3/2005 | Nakajima | 294/68.24 |

FOREIGN PATENT DOCUMENTS

| | | | |
|---|---|---|---|
| JP | 11-343094 | A | 12/1999 |
| JP | 33-21145 | B2 | 6/2002 |
| WO | WO 01/23280 | A1 | 4/2001 |

* cited by examiner

*Primary Examiner*—Dean J Kramer
(74) *Attorney, Agent, or Firm*—DLA Piper US LLP

(57) ABSTRACT

A bottom opening type container bottom plates of which can be opened only by a hoisting operation using a crane by performing a simple preparing operation can be realized. A vertical link 32, a lateral link 35, and a link 45 are arranged on a middle between a hoisting plate 31 and open/close arms 43, and an operation cam 41 is provided to the outside of the open/close arms 43. The operation cam 41 is turned to a rise posture or a down posture so that the open/close arms 43 can be switched freely between an opened state or a closed state by the hoisting force, and the state can be checked externally.

2 Claims, 20 Drawing Sheets

Prior Art

Prior Art

Prior Art

Prior Art

Prior Art

BOTTOM DISCHARGE CONTAINER

TECHNICAL FIELD

This disclosure relates to a container for housing and transporting loose bulk materials such as sand and scrap. More particularly, this disclosure relates to a bottom opening type container, bottom plates of which are opened or closed arbitrarily only by hoisting or hoisting-down operations using a crane after a simple preparing operation is performed so that contents can be discharged.

BACKGROUND ART

Goliath cranes such as unloaders which are installed in quays use grab buckets which grab and land loose bulk materials such as coal and sand from holds. The grab buckets are hoisted or hoisted down and opened or closed by a remote operation in an operator's cabin of a crane, but these operations can be performed only on grab buckets which are attached to cranes via wire ropes. The buckets, therefore, cannot be transported to another places. Steel materials, steel scrap, and the like can be hoisted or hoisted down by lifting magnets, but when they are stacked, only they near the surface can be attracted by the lifting magnets. The most efficient and general cargo work units are, therefore, units using containers (bags), but in the case of containers, loading and discharging take a along time, and this case is not efficient. Further, in the case of a container bottom plates of which are opened or closed and contents of which are discharged, there arise safety problems such that an worker who opens or closes the bottom plates cannot be seen by an operator in a crane, and the worker might be injured by dropping discharged contents. Therefore, some containers have been proposed. In using the containers, a preparing operation such that bottom plates are automatically opened when containers are hoisted down, landed, and again hoisted, is performed in advance, workers do not have to reach at the time of discharging contents.

One example of such containers is shown in FIG. 14. Reference numeral 1 designates a container made of a steel plate, reference numeral 11 designates an opening/closing type bottom plate, and reference numeral 12 designates a hinge for opening or closing the bottom plates 11. Reference numeral 13 designates a locking pin which is provided near a distal end of the bottom plate 11 to be opened or closed and which restricts opening of the bottom plates 11 by means of an open/close control mechanism, mentioned below, and reference numeral 14 is a side plate of the container 1. Reference numeral 3 designates a hoisting portion which is provided near the bottom plates 11 and used when the container 1 is hoisted by a crane, and reference numeral 18 designates a fork hole which is used for loading the container 1 using a forklift or the like. In this drawing, a roof portion of the container 1 is opened, but it is occasionally covered by a sheet or the like.

FIG. 15 is a perspective view illustrating a state that the container 1 is hoisted by using a hoisting frame 2 and the bottom plates 11 are opened. Reference numeral 21 designates an auxiliary wire rope which is used between the hoisting frame 2 and the hoisting portion 3 of the container 1, and reference numeral 431 designates a hook portion which locks the locking pin 13 with a main body of the container 1.

As to such kind of container, the hook portion 431 is locked and the bottom plates 11 are not opened, normally. When, however, contents are discharged, the preparing operation for releasing lock is performed in advance, and the container is hoisted and landed, so that the hook portion 431 is released and the bottom plates 11 are opened. Not shown in FIGS. 14 and 15, an open/close control mechanism is provided near the hook portion 431, namely, near the bottom plates 11.

As one conventional example of the open/close control mechanism, one embodiment of the bottom opening type container disclosed in Japanese Patent No. 332114 is explained with reference to the drawings. This container is of bottom opening type, and it is hung at four points on the bottom portion illustrated above in FIG. 15.

FIG. 16 is a front view illustrating the open/close control mechanism 4 of the conventional bottom opening type container. Parts which are common to those explained above are designated by the same reference numerals. Reference numeral 31 designates a hoisting plate which extends from four corners on the bottom portion of the container 1, reference numeral 32 designates a hoisting hole provided on outer end of the hoisting plate, reference numeral 34 designates an intermediate link which connects the hoisting plate 31 and an upper end of an open/close arm 43 which restrains the bottom plate 11, reference numeral 42 designates a rotary rod which is attached to the bottom portion of the side plate 14 in a vertical direction, reference numeral 432 designates a pressing portion which is provided to upper and lower two places of the side surface of the open/close arm 43 and locks an elevating block 422 in open and closed positions of the open/close arm 43, reference numeral 423 designates a spring retaining sleeve, reference numeral **49*b* designates a pressing-down spring which assists a empty weight of the elevating block 422** and presses it down.

In the open/close control mechanism 4, an operation lever 421 is turned so that the rotary rod 42 which is integral with the operation lever 421 is rotated, and the open/close arms 43 which lock the distal ends of the bottom plates 11 are controlled so as to be opened or closed according to positions, upper or lower, of the elevating block 422 into which the rotary rod 42 is inserted and which is engaged with the rotary rod 42 and elevates in an interlocking manner, and the open/close operation of the open/close arms 43 is performed by the hoisting plates 31 connected to them via the intermediate links 34.

The using method of the container 1 is explained below. Since the open/close control mechanism 4 is constituted symmetrically, only one side is explained with reference to the drawings. In order to secure the open/close control safely, it is desirable that the open/close control mechanism 4 is provided also to the other side in FIG. 15. For this reason, four sets of mechanisms corresponding to FIG. 17 are provided to one container 1.

FIG. 17 illustrates a basic state that the bottom plates 11 are closed the same as FIG. 16, and corresponds to the left half portion of FIG. 16. The operation lever 421 faces a left side with respect to the rotary rod 42. According to the engagement of a groove portion of the rotary rod 42 and the elevating block 422, mentioned below, the elevating block 422 is in an ascended position. The open/close arm 43 is biased by an open spring **49*a* to an open direction, but an upper pressing portion 432*a* of two pressing portions provided to an upper and a lower portions of the side surface of the open/close arm 43 presses the elevating block 422, so that the open/close arm 43 cannot be opened. If, therefore, the container 1 is hoisted and landed in this state, the bottom plates 11** are not opened.

In the landed state, as shown by an arrow of FIG. 17, the operation lever 421 is pulled to a front side so as to be rotated to a right side. The rotary rod 42 rotates and the elevating block 422 can be descended, but since the open/close arm 43 still presses the elevating block 422 due to the open spring 49*a,* the elevating block 422 cannot descend yet.

A wire rope is inserted into the hoisting hole 32 so that the container 1 is hoisted. The hoisting plate 31 is rotated by a fixed pin 47*a,* and the intermediate link 34 and the upper end of the open/close arm 43 are drawn via a link pin 48*a.* For this reason, the elevating block 422 is released from the open/close arm 43 so as to drop and is in a middle position on a stepped portion of the lower pressing portion 432*b.* This state is shown in FIG. 18.

When the container 1 reaches destination and the container 1 is once landed, the force for hoisting the hoisting plate 31 is weakened, the open/close arm 43 is opened by the function of the open spring 49*a,* and the elevating block 422 drops to the lower end, and the open/close arm 43 is pressed against the pressing portion 432*b* so as to be maintained in the opened state. This state is shown in FIG. 19. When the container 1 is hoisted in this state, the bottom plates 11 are opened due to the weight of the contents and the empty weight of the bottom plates 11 so that the contents are discharged.

That is to say, when the operation lever 421 is in the basic state where it is directed left, the bottom plate 11 is not opened, and only when the operation lever 421 is directed right so that the container 1 is landed and hoisted, the bottom plates 11 are opened. When the operation lever 421 is returned to the left, the container 1 is once landed, and the bottom plates of which are closed, and the container 1 is hoisted, the container 1 is returned to original state thereof. When the elevating block 422 does not drop securely due to its empty weight even if the rotary rod 42 rotates, it is desirable that the pressing-down spring 49*b* which biases the elevating block 422 downward, is suitably inserted. The spring retaining sleeve 423 receives the pressing-down force so as to transmit it to the elevating block 422.

FIG. 20 illustrates a section of a portion formed with the groove portion 424 of the rotary rod 42, and FIGS. 21A and 21B are perspective views in an A position and a B position of the groove portion 424 formed on the side surface of the rotary rod 42. A set pin, not shown, protrudes from the elevating block 422 towards the rotary rod 42 so as to be engaged with the groove portion 424. When the groove portion 424 is developed, it is a right-angled triangle where hypotenuse is lower side, and a groove of an up-and-down direction is provided on the left side, namely, the position A of FIG. 20, and the opposite side, namely, the position B of FIG. 20 is an apex, and thus a freedom of an up-and-down direction is not provided. The basic state that the bottom plates are closed, namely, a state that the operation lever 421 directs the left is the position B, and a state that the operation lever 421 is released, namely, directs the right is the position A. After the elevating block 422 drops along the groove in the up-and-down direction of the groove portion 424 in the position A, when the operation lever 421 is returned to the left, the elevating block 422 ascends along the hypotenuse of the groove portion 424, so as to return to the position B.

The above-mentioned bottom opening type container is constituted so that after the preparing operation is performed in advance, when the bottom opening type container is transported, hoisted down in a load discharge place so as to be landed, and hoisted again, the bottom plates are automatically opened. A worker does not have to be near the container when the contents are discharged. The problem of safety is solved, but the following problems remain and thus they are desirably further solved;

a) a number of parts is large and the constitution is complicated, and when mechanical resistance such as frictional force is large, the container is not opened, and thus the opening operation is not secure;

b) a check cannot be made externally whether the preparing operation for opening is performed or not; and c) when the open/close control mechanism 4 is provided also to the other side of the container, in order to perform the preparing operation for opening, the worker should approach both the sides of the container.

SUMMARY

I provide a bottom opening type container in which an open/close operation of an open/close arm is more secured with a simple constitution, a preparing operation for opening can be performed only on one side of the container, and the state of the preparing operation can be checked visually.

The container is a bottom opening type container composed of side plates and a pair of bottom plates, having hinges of the bottom plates attached to near bottom portions of the side plates, locking pins provided near distal ends of the bottom plates, and a pair of open/close arms which are pivotally supported at around center portions thereof by fixed pins fixed to the side plates, and which interlock with each other via gear portions, and which are capable of locking the locking pins by lower end hook portions thereof, the container having an open/close control mechanism including: a hoisting plate which is supported pivotally about fixed a pin fixed to an upper portion of the side plate and has a hoisting hole at an outer end thereof for connecting a wire rope to hoist the bottom opening type container; a vertical link one end of which is connected to the hoisting plate and the other end of which is connected to an oscillating link swingably supported to a fixed pin fixed to a lower portion of the side plate; a lateral link one end of which is connected to the oscillating link; a link which is inserted into a hollowed out plate fixed to a lower portion of the side plate, and one end of which is connected to the lateral link, and which is biased to one direction by a return spring; and an operation cam which has a rotating center thereof at a rear surface side of the open/close arm outside of the locking pin, and which restrains the rear surface of the open/close arm in a rise posture to maintain the open/close arms in a close state and releases the open/close arm in a down posture when the bottom plates are closed, wherein in a state that a distal end of the link or an extended portion attached to the distal end is placed on a stepped portion of the hollowed out plate or an upper end of the operation cam in a rise posture, one upper end of the open/close arms is restrained so that the open/close arms are maintained in the close state, wherein in a state that the distal end of the link or the extended portion attached to the distal end drops out of the stepped portion of the hollowed out plate or the upper end of the operation cam in the rise posture, one upper end of the open/close arms is released, wherein the link moves to a horizontal direction interlocking with a movement of the hoisting plate, and the placed state is changed into the dropped state, so that the open/close arms are pressed to an open direction by a hoisting force. The container is desirably the bottom opening type container wherein the open/close control mechanism is provided to both sides viewed from the hinges of the bottom plates, and the respective operation cams are connected to each other via a connecting shaft.

DETAILED DESCRIPTION

Figure 1:
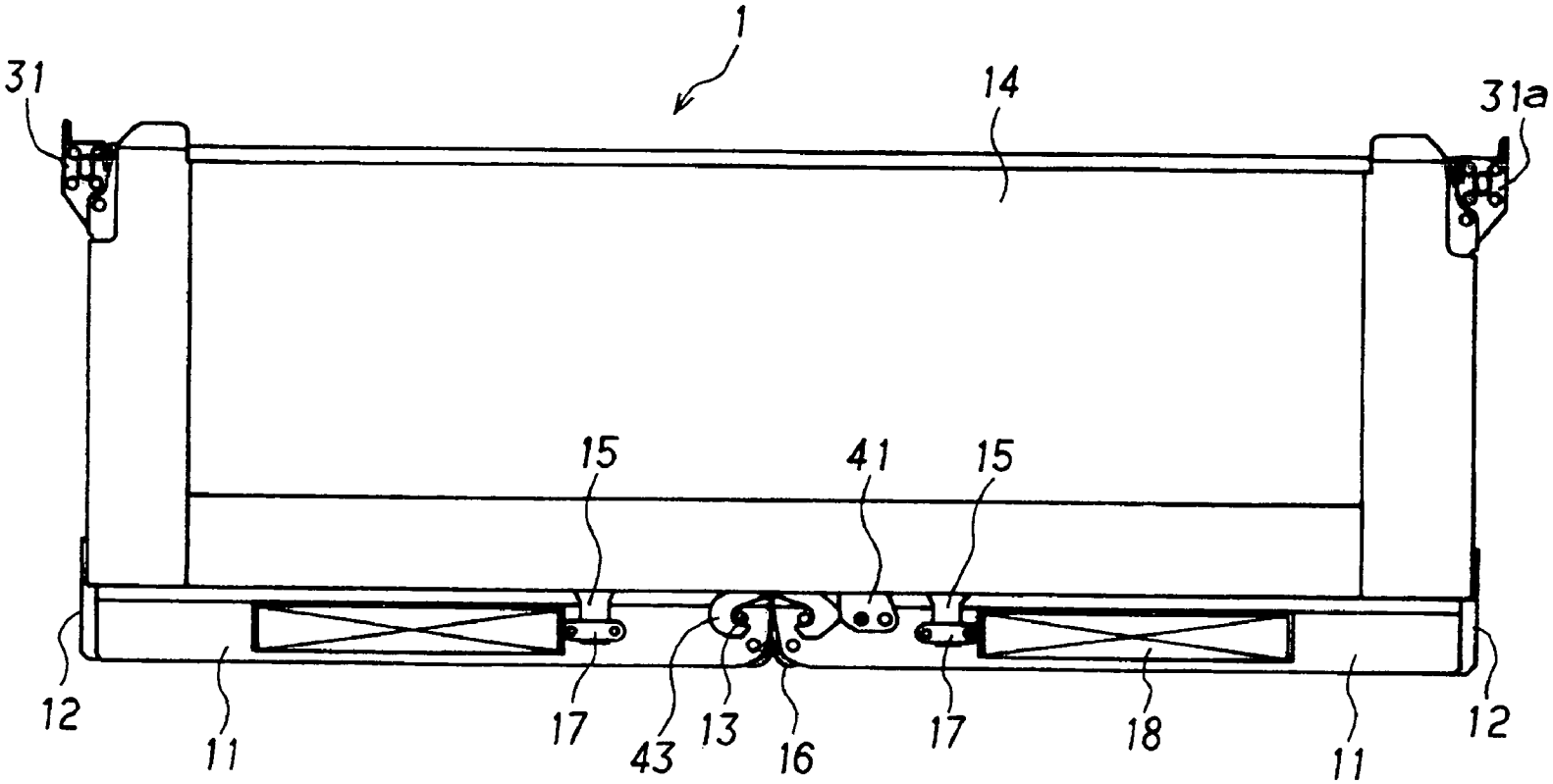
FIG. 1 is a front view illustrating a bottom opening type container.

I first provide a listing of reference numbers and associated structures as follows:

1 container
2 hoisting frame
3 hoisting section
4 open/close control mechanism
11 bottom plate
12 hinge (for opening and closing bottom plate)
13 locking pin
14 side plate
15 bottom plate guide
16 bottom plate roller
17 bottom plate guide receiver
18 fork hole
21 auxiliary wire rope
31, 31*a* hoisting plate
32 vertical link
33 oscillating link
34 intermediate link
35 lateral link
41 operation cam
42 rotary rod
43 open/close arm
44 hollowed out plate
45 link
46*a* to 46*c* fixed pin
47*a* to 47*d* link pin
48*a* to 48*d* connecting pin
49*a* open spring
49*b* pressing-down spring
49*c* return spring
311 hoisting hole
312 connecting bar
313 long hole
411 connecting shaft
412 spring plunger
413, 432 upperend
421 operation lever
422 elevating block
423 spring retaining sleeve
424 groove portion
431 hook portion
432*a*, 432*b* pressing portion
433 gear portion
434 intermediate stepped portion
441, 451 locking portion
442 stepped portion
452 distal end
453 extended portion
W hoisting wire rope A bottom opening type container as follows:

(a) the same function as that of the conventional art can be realized by a small number of parts;
(b) since an open/close arm 43 is opened by a hoisting load, even if mechanical resistance such as frictional force is strong, it can be operated securely;
(c) a check can be easily made by viewing a direction of an operation cam whether a preparing operation for opening is performed or not; and
(d) since operation cams on both sides of the container are connected by a connecting shaft, the preparing operation for opening can be performed only on one side of the container.

An example of the container will be explained with reference to the drawings. The container of this aspect is of a bottom opening type and similarly to the example shown in FIGS. 14 to 21, it is hoisted at four corner points of the bottom portion. However, a hoisting position is an upper portion of a side plate of the container.

Figure 2:
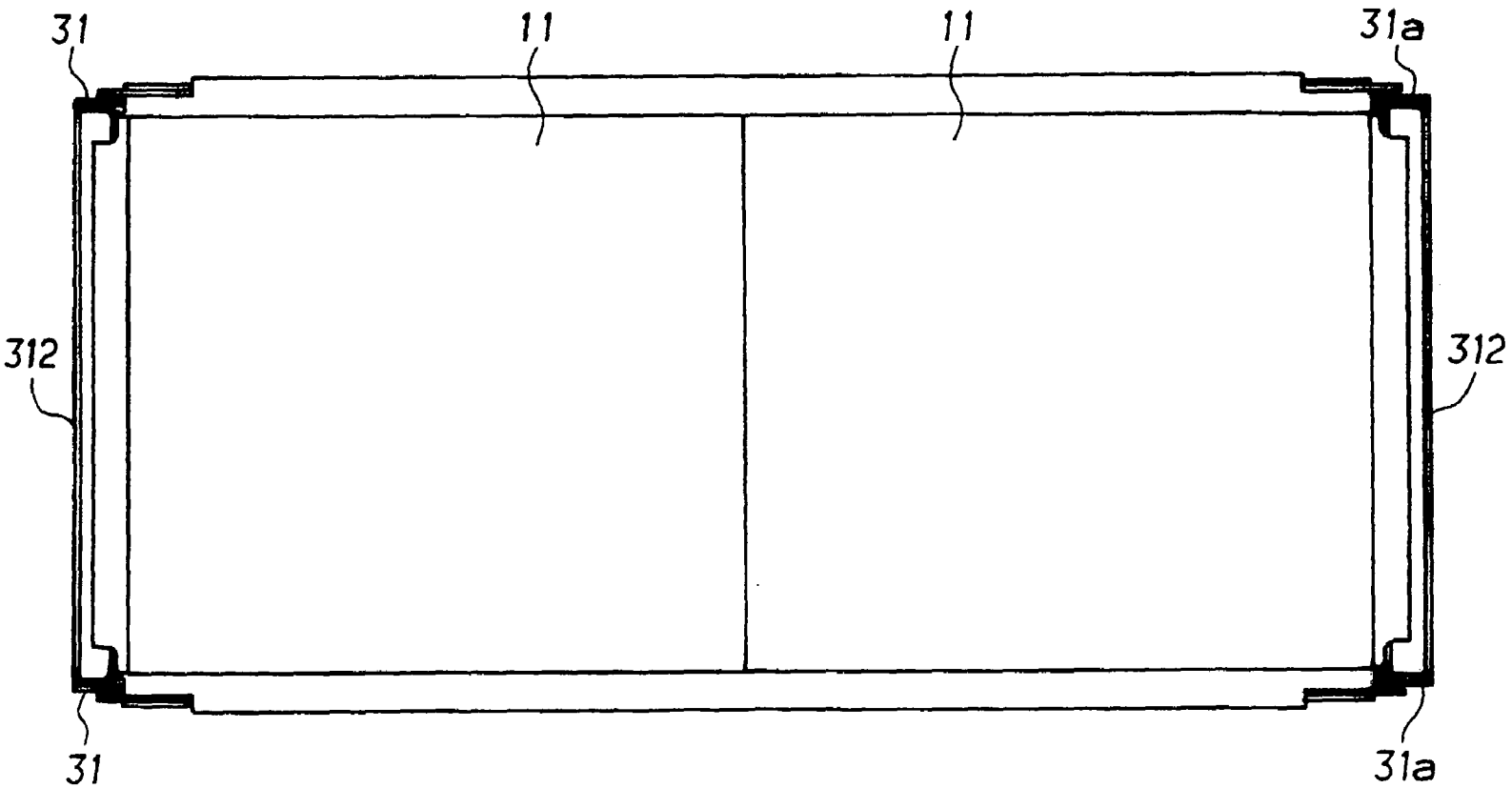
FIG. 2 is a plan view illustrating the bottom opening type container.
Figure 3:
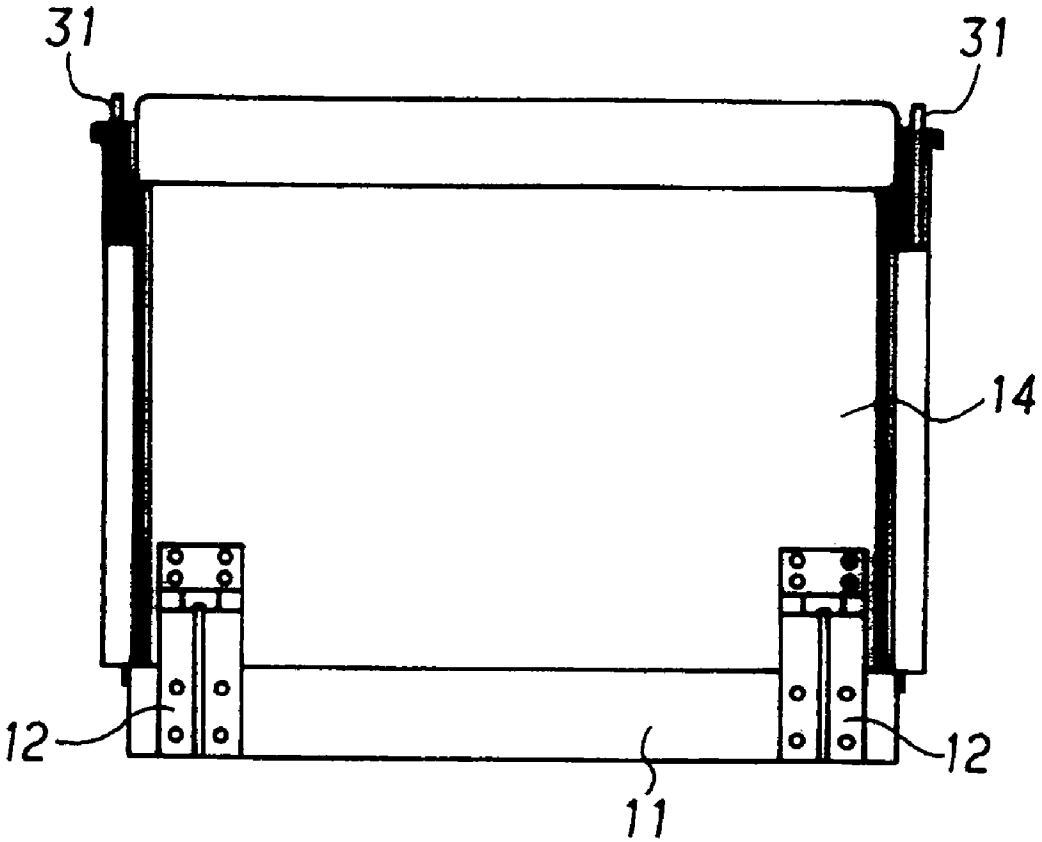
FIG. 3 is a side view illustrating the bottom opening type container.

FIG. 1 is a front view illustrating the bottom opening type container, and FIG. 2 is a plan view, FIG. 3 is a side view. In the drawings, common parts to those in the above explanation are designated by the same reference numerals. Reference numeral 15 designates a bottom plate guide which is attached to a lower portion of the side plate in order to prevent the side plate 14 from being deformed outward by contents, reference numeral 16 designates a bottom plate roller which is attached to a contact position with a floor surface in order to open or close bottom plates smoothly when the container 1 is hoisted and hoisted down, reference numeral 17 designates a bottom plate guide receiver which is provided to a bottom plate in order to insert the bottom plate guide 15, reference numeral 31*a* designates two fixed side hoisting plates of four hoisting plates which do not interlock with an open/close control mechanisms, reference numeral 312 designates an angle-shaped connecting bar which connects the hoisting plates on both sides, and reference numeral 41 designates an operation cam which operates the open/close control mechanism. Two sets of the open/close control mechanisms 4 are provided to a front surface and a rear surface, respectively.

Figure 7:
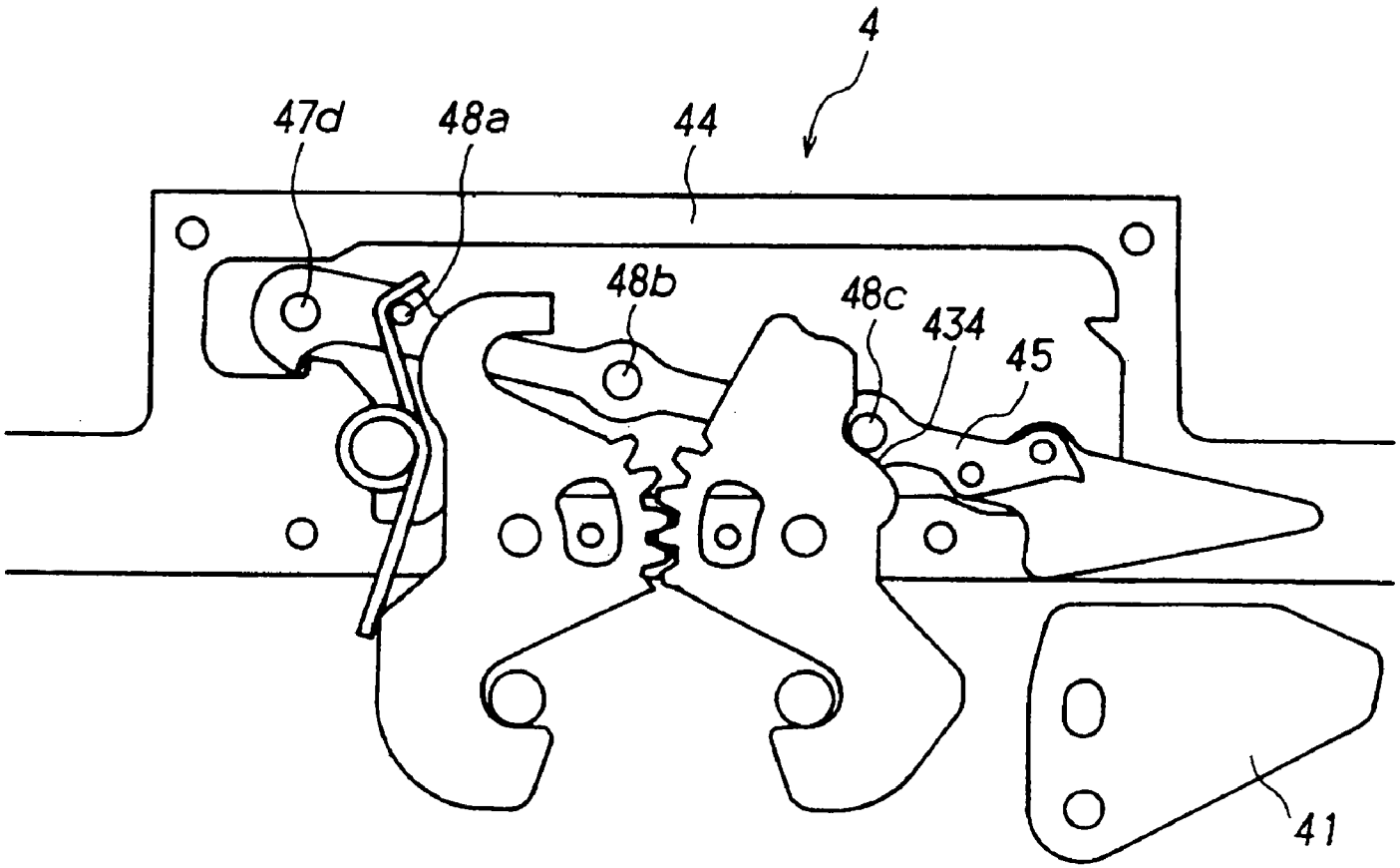
FIG. 7 is a partial front view illustrating the open/close control mechanism.
Figure 8:
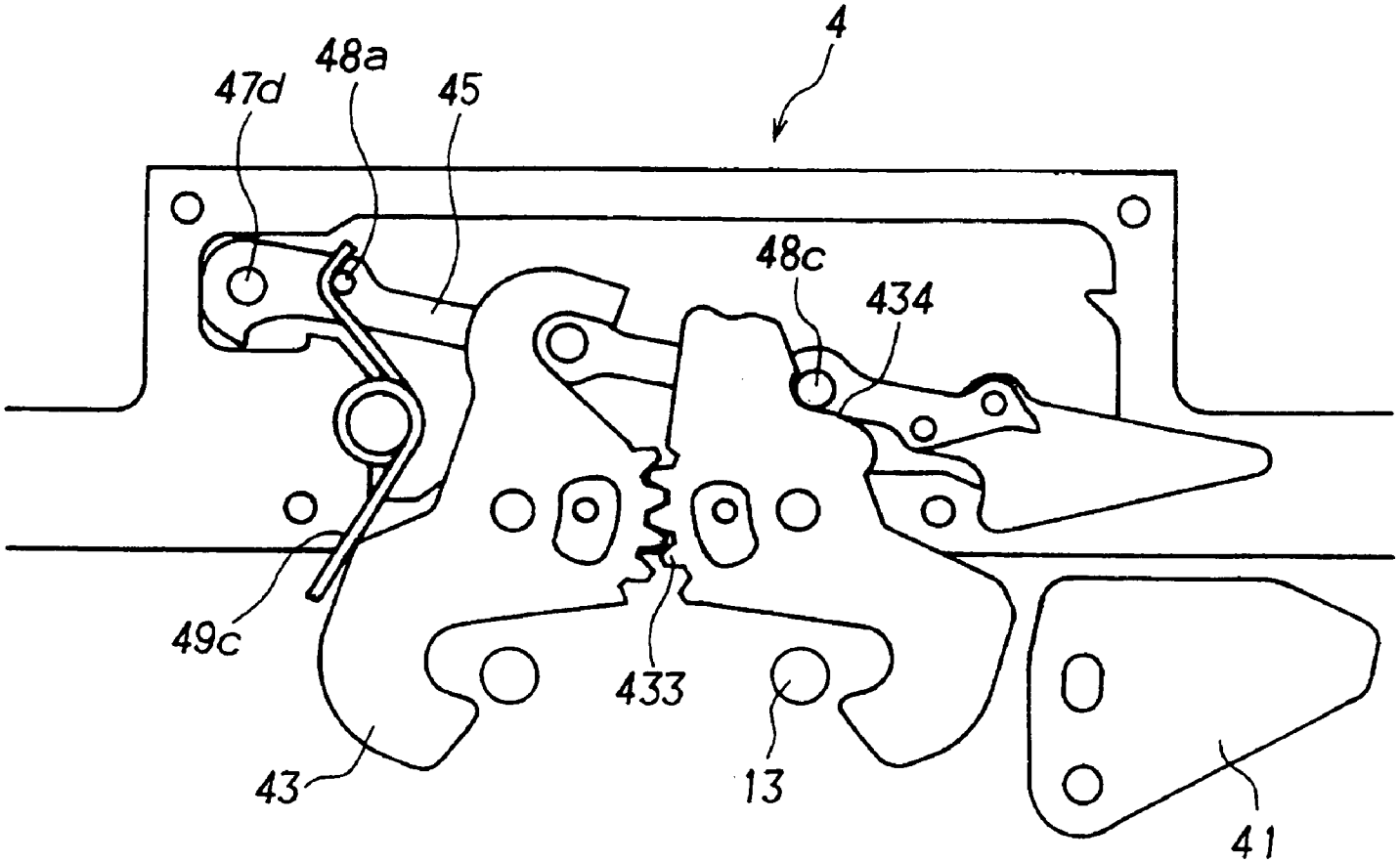
FIG. 8 is a partial front view illustrating the open/close control mechanism.
Figure 9:
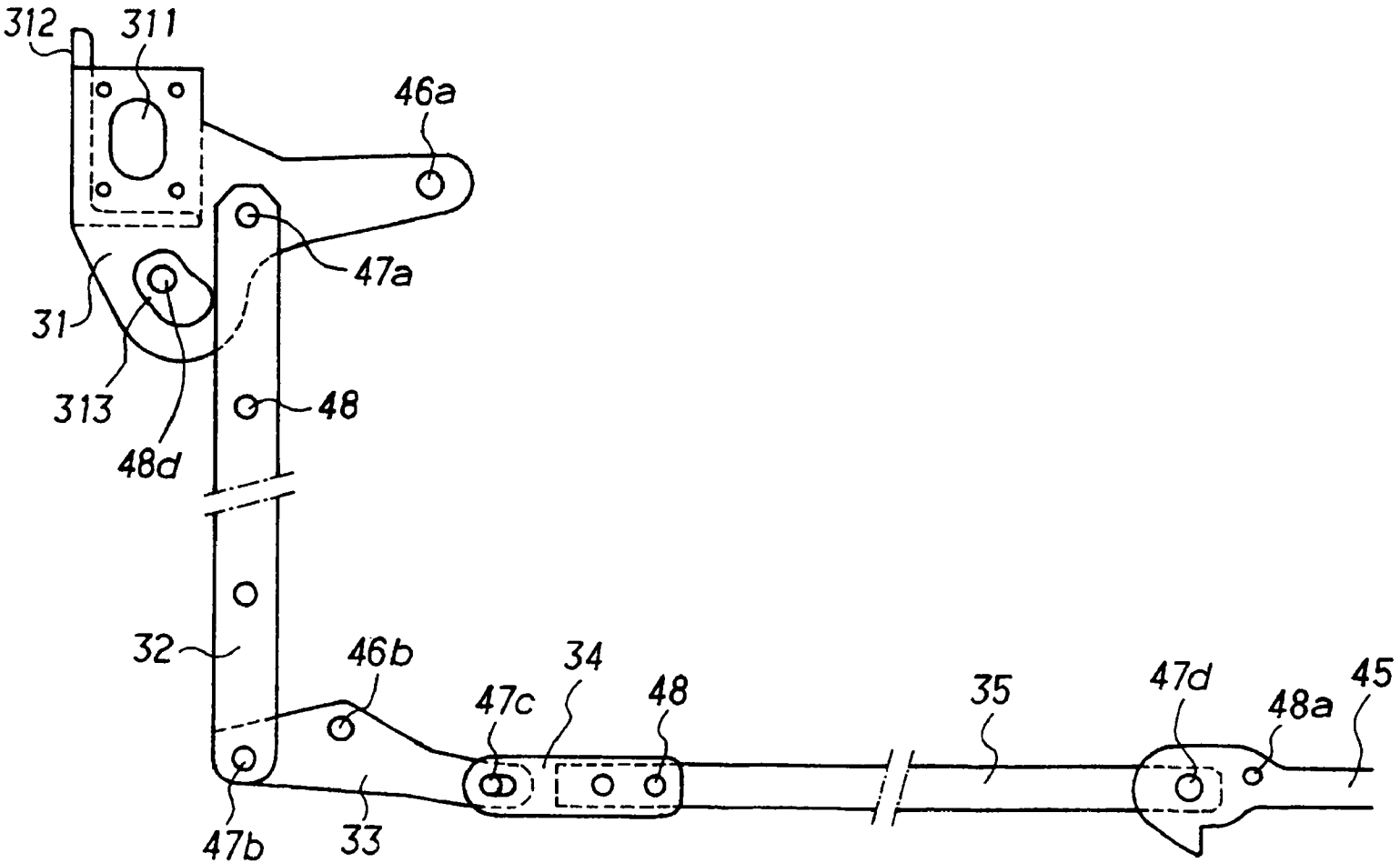
FIG. 9 is a partial front view illustrating a hoisting mechanism.
Figure 10:
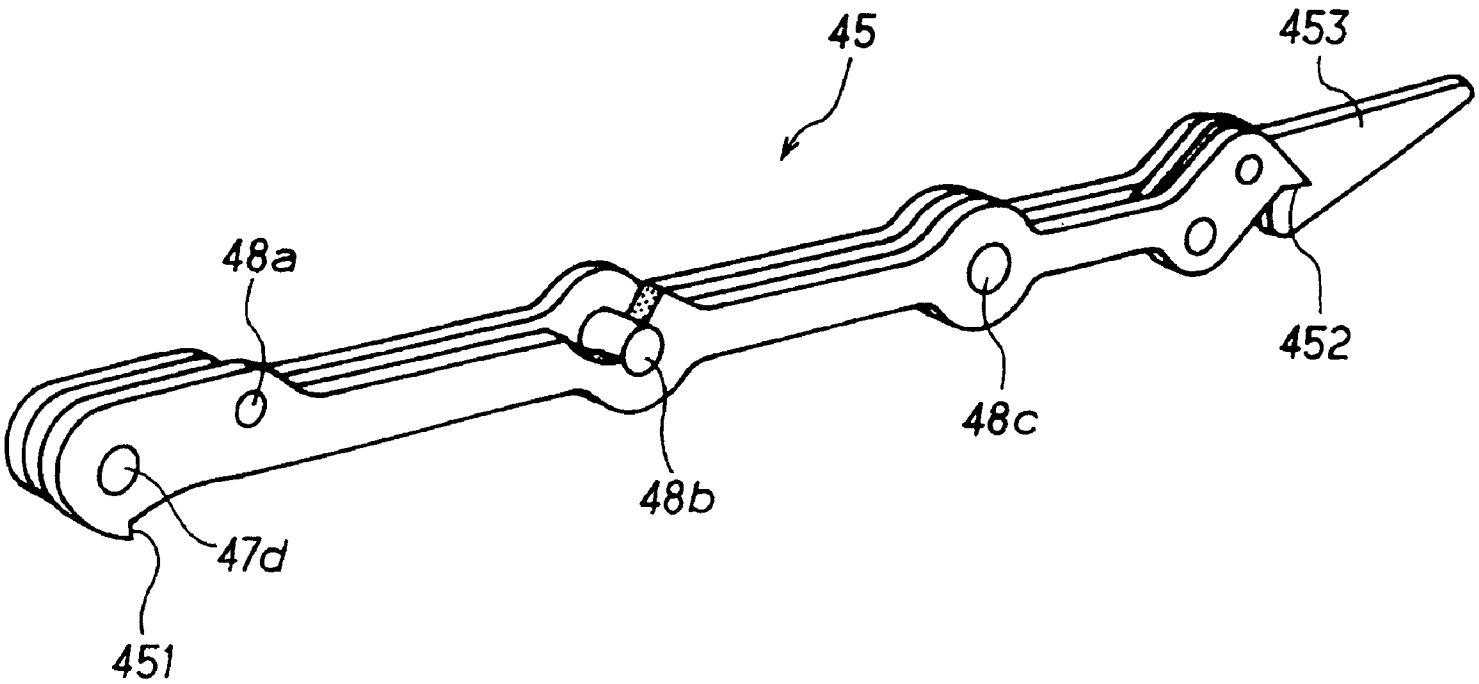
FIG. 10 is a perspective view illustrating a link as a part of the open/close control mechanism.
Figure 11:
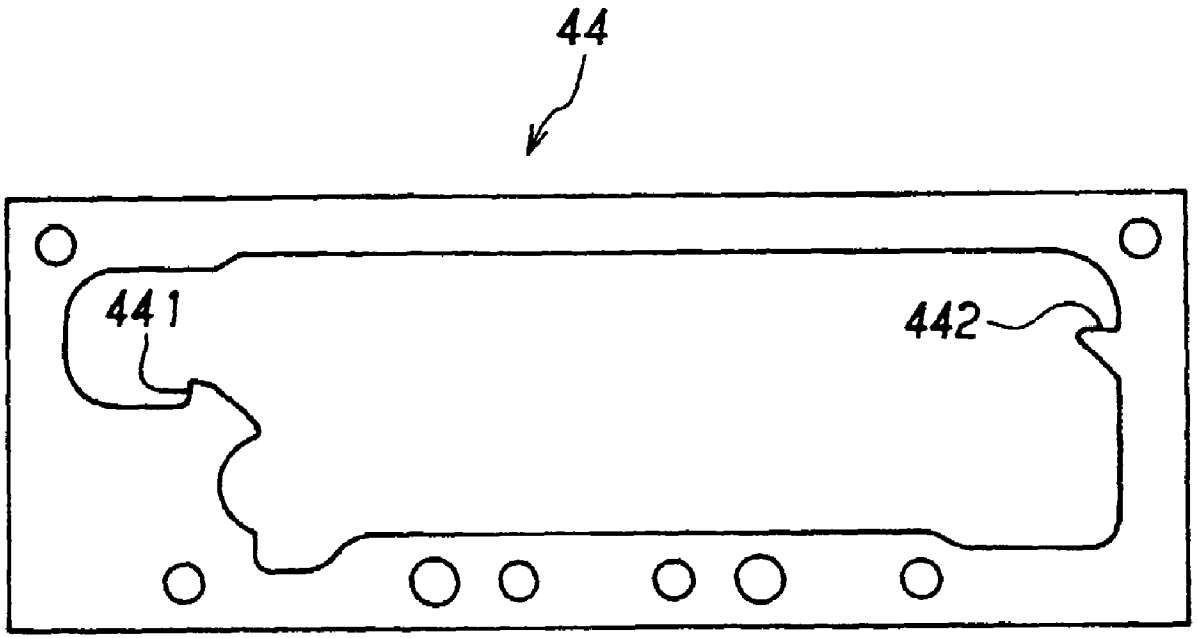
FIG. 11 is a front view illustrating a hollowed out plate as a part of the open/close control mechanism.
Figure 12:
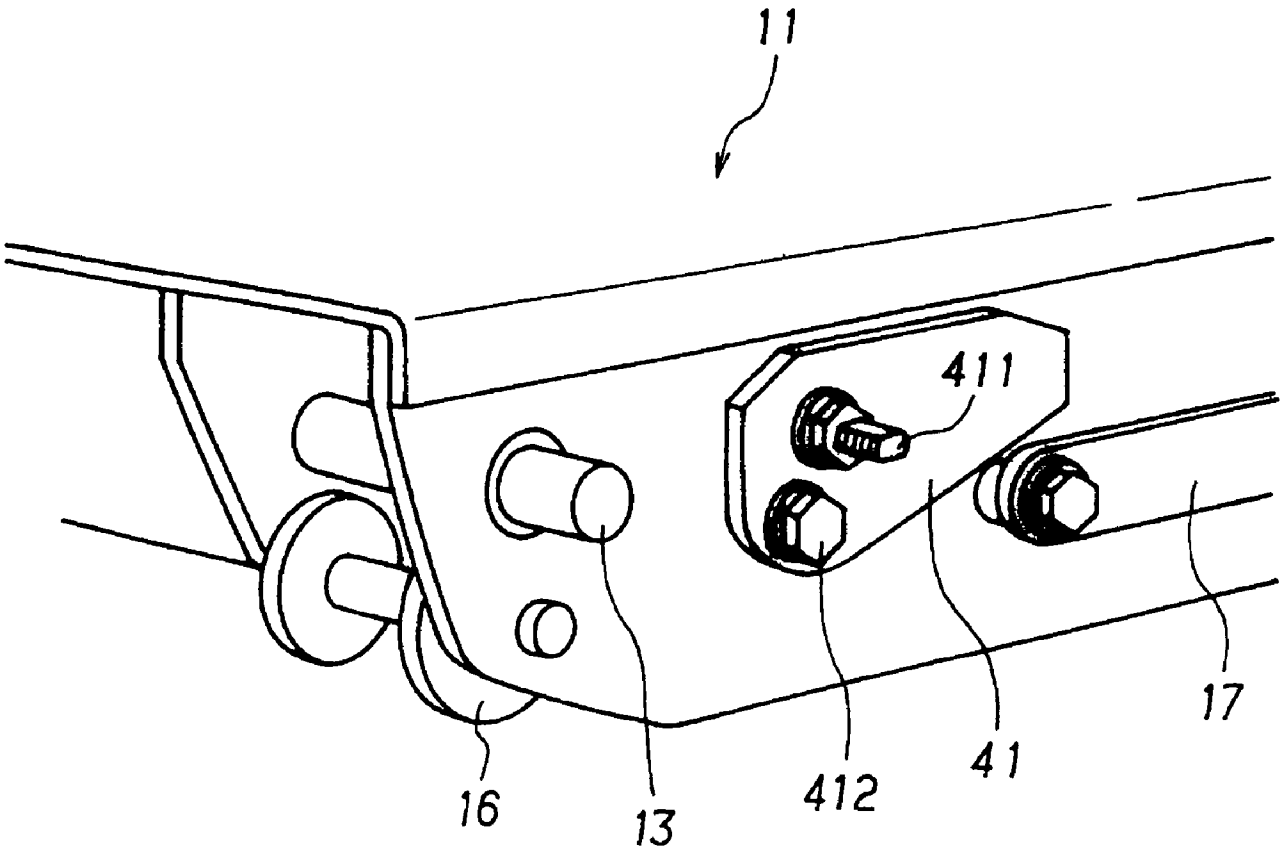
FIG. 12 is a partial perspective view illustrating a main section of a bottom plate.

FIGS. 4 to 8 are front views illustrating various states of the open/close control mechanism 4 in the bottom opening type container, and FIG. 9 is a front view illustrating a link mechanism which transmits a hoisting force from the hoisting plate 31 to the open/close control mechanism 4. FIG. 10 is a perspective view illustrating a link 45, FIG. 11 is a front view illustrating a hollowed out plate 44, and FIG. 12 is a partial perspective view of a bottom plates 11 illustrating a mounting state of a locking pin 13, a bottom plate roller 16, a bottom plate guide receiver 17 and an operation cam 41. Respective reference numerals are common to those in the above explanation, reference numeral 411 designates a revolving shaft of the operation cam 41 and a connecting shaft which connects the operation cams 41 on both sides, reference numeral 412 designates a spring plunger in which a built-in ball is pushed by a spring and then fitted into a concave portion provided to a predetermined position so that the operation cam 41 stops in a rise position or a down position, reference numeral 413 designates an upper end of the fan-shaped operation cam, reference numeral 432 designates an upper end of the open/close arm 43, and reference numeral 433 designates a gear portion of a pair of the open/close arms 43 which are formed with a part of an involute gear. reference numeral 44 designates a hollowed out plate which is attached to a lower part of the side plate and which is formed with a locking portion 441 on its one end and a stepped portion 422 on the other end. reference numeral 45 designates a link which is connected to a terminal of the hoisting mechanism, reference numeral 451 designates a locking portion of one end, reference numeral 452 designates a distal end, and reference numeral 453 designates an extended portion which is further extended from the distal end 452 as shown in FIG. 10.

Reference numeral 46 (46*a* to 46*c*) designates a fixed pin as a revolving shaft for a link or the like arranged in predetermined places, and reference numeral 47 (47*a* to 47*d*) designates a link pin in a connecting position which connects respective links. reference numeral 48 (48*a* to 48*c*) designates a connecting pin which connects the links when the links are composed of two plates. Reference numeral 49*c* designates a return spring, a chord wound portion of which is fitted into a recess of the hollowed out plate 44 and both ends of which bias the link 45 and the open/close arm 43. The return spring pushes the link 45 to an opposite direction to the hoisting direction, and pushes the open/close arm 43 to a close direction.

Before the open/close control mechanism 4, FIG. 9 will be explained. Two of the four hoisting portions are the fixed hoisting plates 31*a* as mentioned above, but the remaining two are movable hoisting plates 31 which rotationally move about the fixed pins 46*a*. Up-down movement of the movable hoisting plates 31 is transmitted to a vertical link 32 and changed into a horizontal movement by an oscillating link 33, and transmitted to a lateral link 35 via an intermediate link 34, and the hoisting force is changed into a force directing left by a link pin 47*d* so that the link 45 is operated. The rotational moving range of the hoisting plate 31 is regulated in such a manner that the end of a long hole 313 which is longer in a circumferential direction butts against a connecting pin 48*d*. To prevent the hoisting load from directly acting on respective portions of the open/close control mechanism 4, it is desirable that the moving range of the link 45 in the hollowed out plate 44 has slight margin in the state that the end of the long hole 313 comes in contact with the connecting pin 48*d*.

Figure 4:
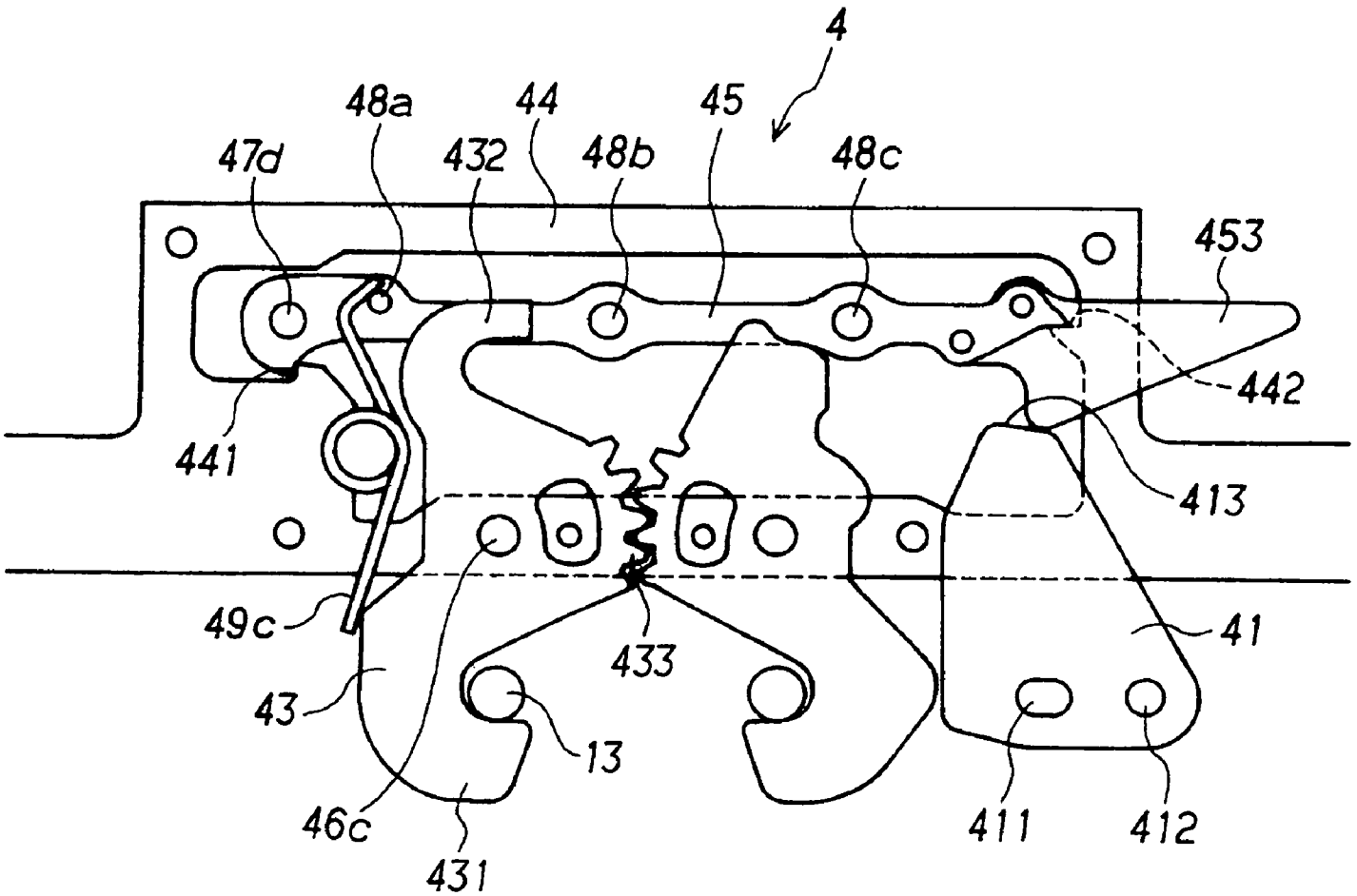
FIG. 4 is a partial front view illustrating an open/close control mechanism.

The operation of the open/close control mechanism 4 will be explained in detail with reference to FIGS. 4 to 8. FIG. 4 illustrates a standard state of the container, namely, a state that the bottom plates are closed regardless of presence or non-presence of contents and the container is not hoisted but put down. The case where the container which has the contents is hoisted and transported to a load discharge place is assumed in the explanation.

In FIG. 4, the operation cam 41 is positioned in a vertical position, arm of which faces upward, and this state is called as "rise posture". As explained above, the hoisting force acts on the left-end link pin 47*d* of the link 45 in a left direction, but since this force does not act now, the link 45 is pushed to the right by the return spring 49*c* and stopped in a position where the locking portion 451 of the link 45 is locked with the locking portion 441 of the hollowed out plate 44. The distal end 452 of the link 45 is placed on the stepped portion 442 of the hollowed out plate 44, and the extended portion 453 of the link 45 is placed on the upper end 413 of the cam. On the other hand, the open/close arm 43 is in the close state, and hook portion 431 of which locks the locking pin 13 of the bottom plate 11.

The position of the locking pin 13 is set just below or the slightly inner side of the fixed pin 46*c* as the rotating center of the open/close arm 43, so that the bottom plates 11 can be prevented from being opened due to the weight of the contents in the container. An external force other than a force which acts on the left open/close arm 43 to the close direction by the return spring 49*c* is not applied, and thus the open/close arm 43 is not open. Even if it is tried to be opened, the operation cam 41 on the rear surface side of the right open/close arm 43 is in the vertical direction, and thus the open/close arm 43 cannot be opened as long as the operation cam 41 is not turned to the down posture.

Figure 5:
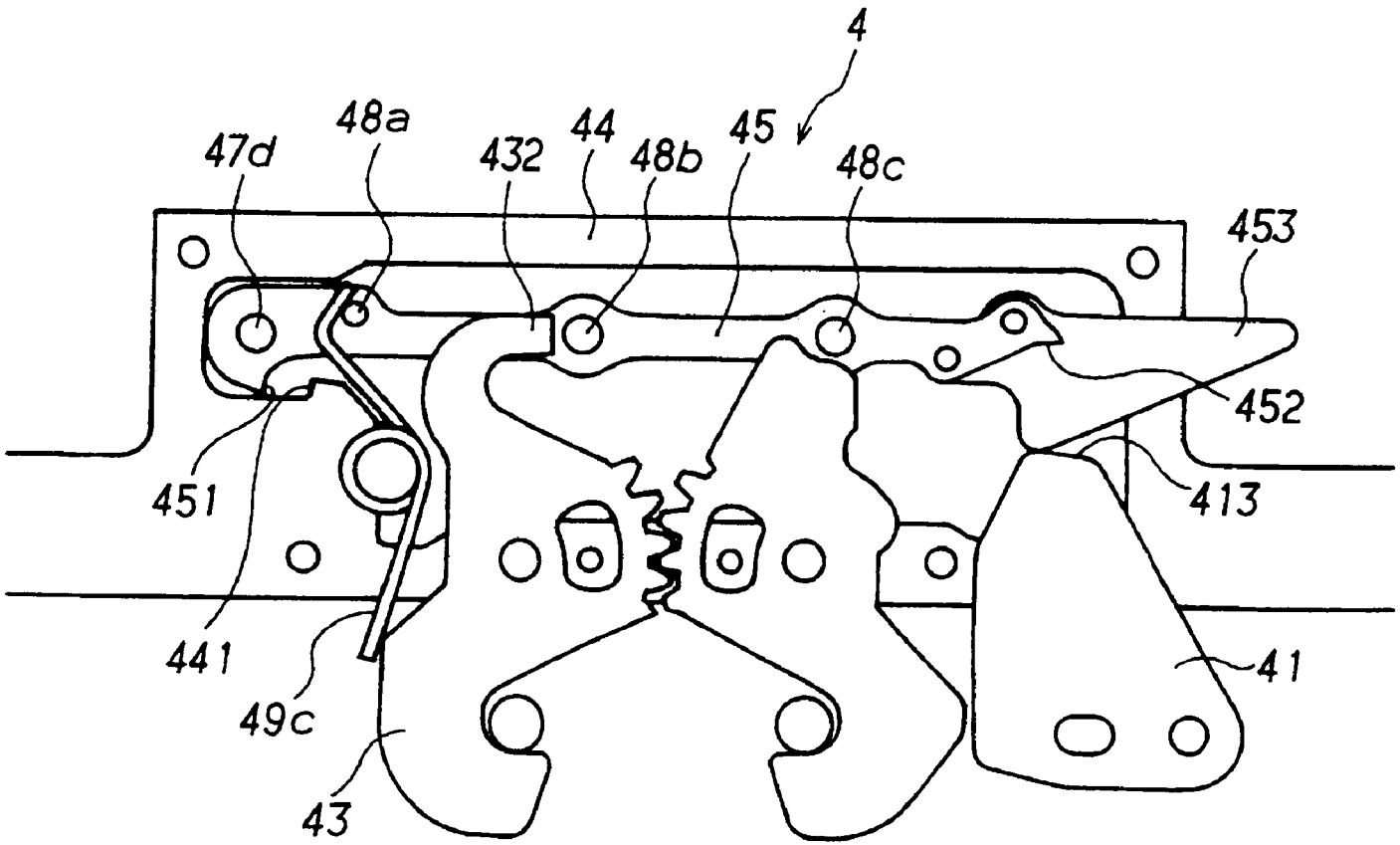
FIG. 5 is a partial front view illustrating the open/close control mechanism.

The container is hoisted. FIG. 5 illustrates this state, and the link 45 is moved to the left direction by the hoisting force, and the distal end 452 is separated from the stepped portion 442 of the hollowed out plate 44. The extended portion 453 is, however, still on the upper end 413 of the operation cam 41. When the container is on the land and the hoisting force is eliminated, the link 45 moves to the right direction so as to be back to the state of FIG. 4. The bottom plates 11 of the container are kept closed, and the container can be moved arbitrarily.

Figure 6:
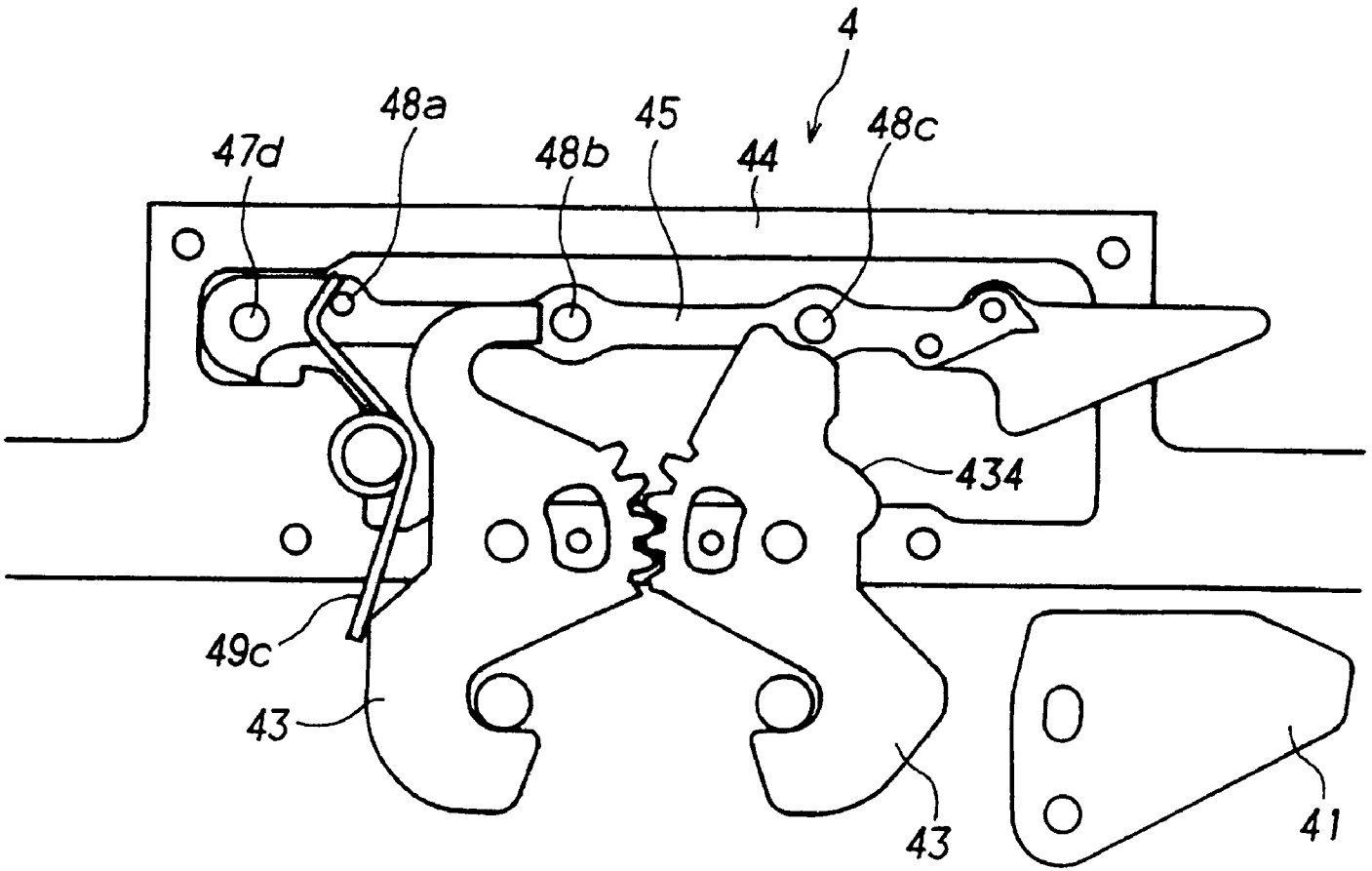
FIG. 6 is a partial front view illustrating the open/close control mechanism.

As the preparing operation for opening the bottom plates of the container, the operation cam 41 is turned right in the landed state. The state that the arm faces right shown in FIG. 6 is called as "down state".

Since the end of the connecting shaft 411 as the revolving shaft of the operation cam 41 is formed with pancake-shaped parallel surfaces, by which a handle is fitted into or a simple tool such as a spanner is used, so that the direction of the operation cam 41 can be changed. Since this operation cam 41 is connected to the operation cam on the other side of the container by the connecting shaft 411, all the operations can be performed only on one side.

When the container, thereafter, is hoisted, as shown in FIG. 6, the link 45 again moves to the left direction, and the connecting pin 48*c* is placed on the upper end of the right open/close arm 43, so that the link 45 is maintained in the horizontal posture. When, however, the container is landed and the hoisting force is weakened, the operation cam 41 is in the down posture, so that, as shown in FIG. 7, the link 45 moves right. The connecting pin 48*c* drops along an upper profile of the right open/close arm 43 and is on an intermediate stepped portion 434. This is a waiting state that the bottom plates 11 can be opened.

When the container is hoisted, as shown in FIG. 8, the link 45 in the dropped state is drawn left by the hoisting force, and the connecting pin 48*c* presses a shoulder of the intermediate stepped portion 434 of the right open/close arm 43. For this reason, the right open/close arm is opened, and the left open/close arm which is geared with the right one via the gear portion 433 is simultaneously opened. As a result, both the locking pins 13 are released, and the bottom plates 11 are opened by its empty weight and the weight of the contents so that the contents are discharged.

After the discharge, the container is landed, the bottom plates 11 are closed, and the operation cam 41 is returned to the "rise posture" so as to be again in the state of FIG. 4.

Figure 13:
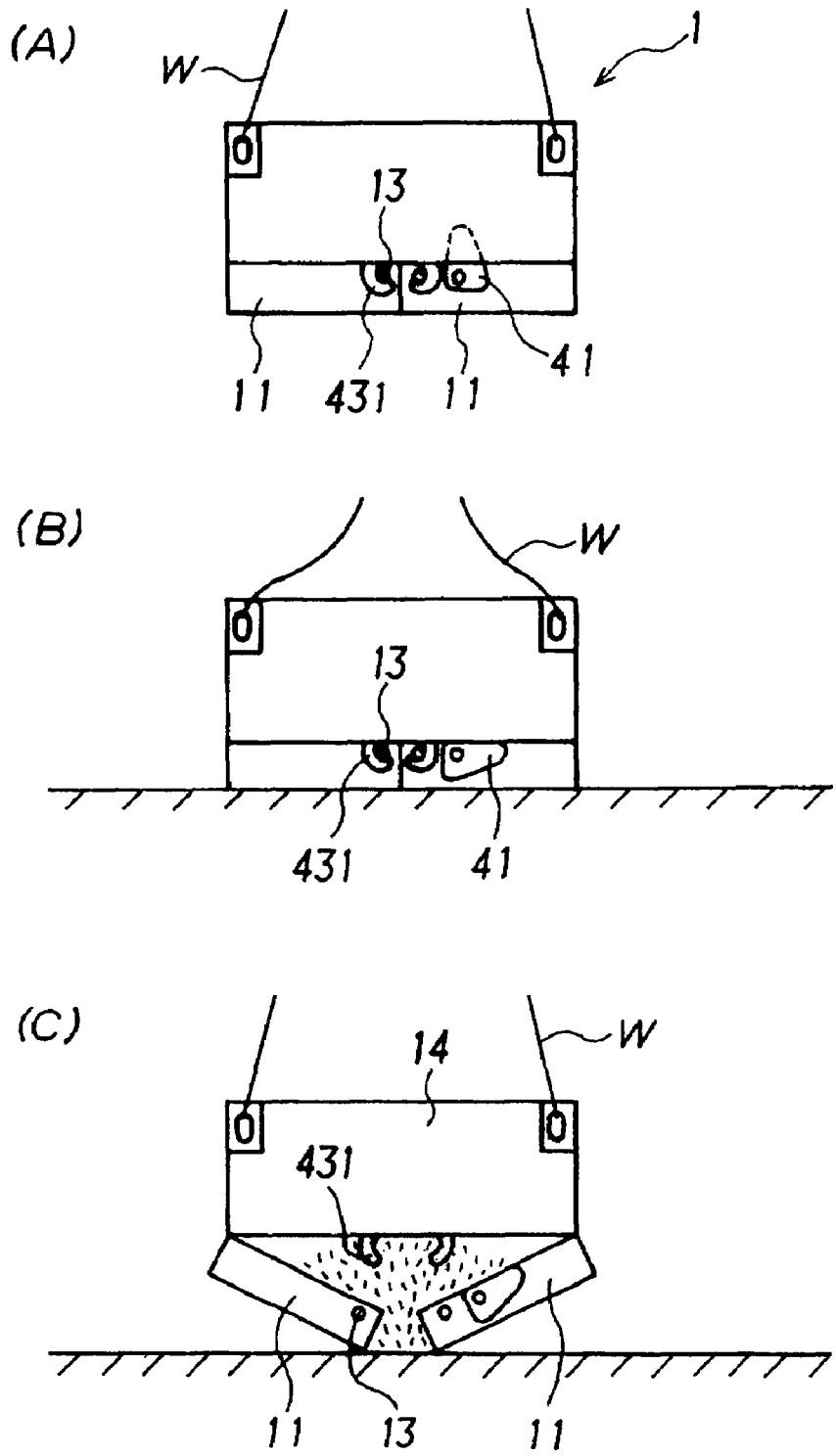
FIGS. 13A to 13C are explanatory diagrams illustrating using states of the bottom opening type container.
Figure 14:
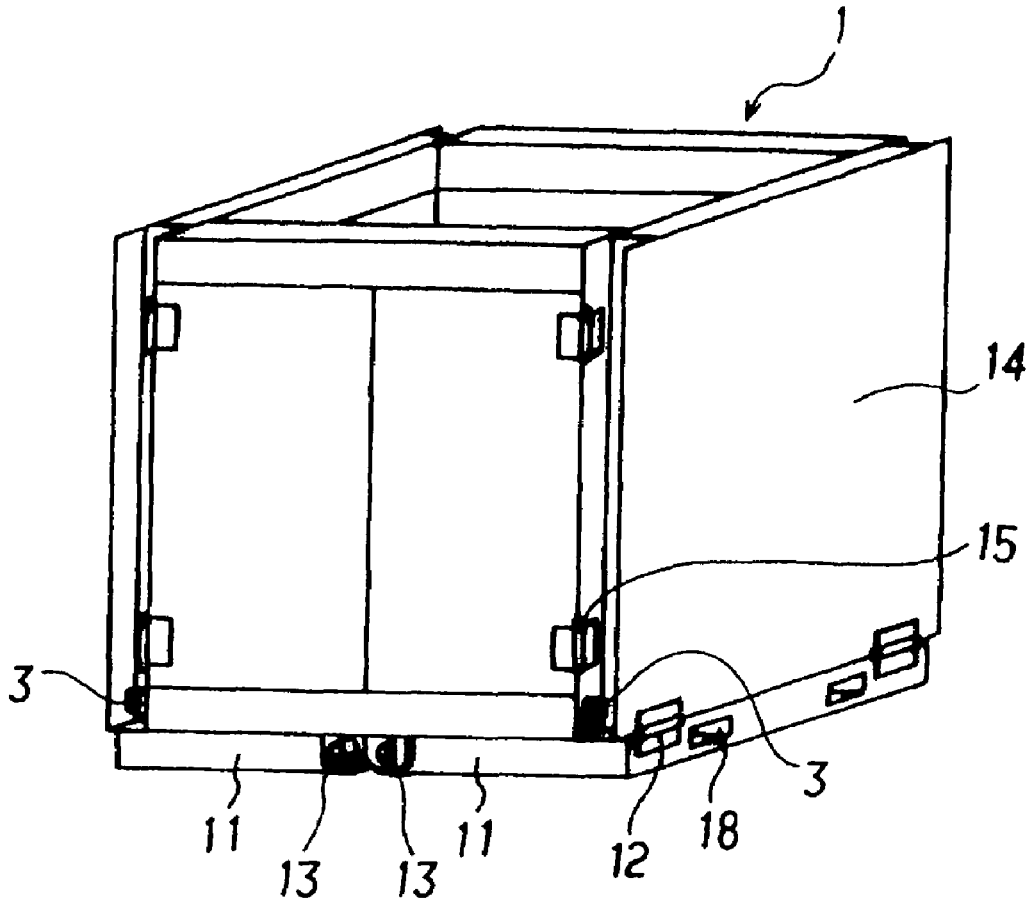
FIG. 14 is a perspective view illustrating a state that the bottom plates of the bottom opening type container are closed.
Figure 15:
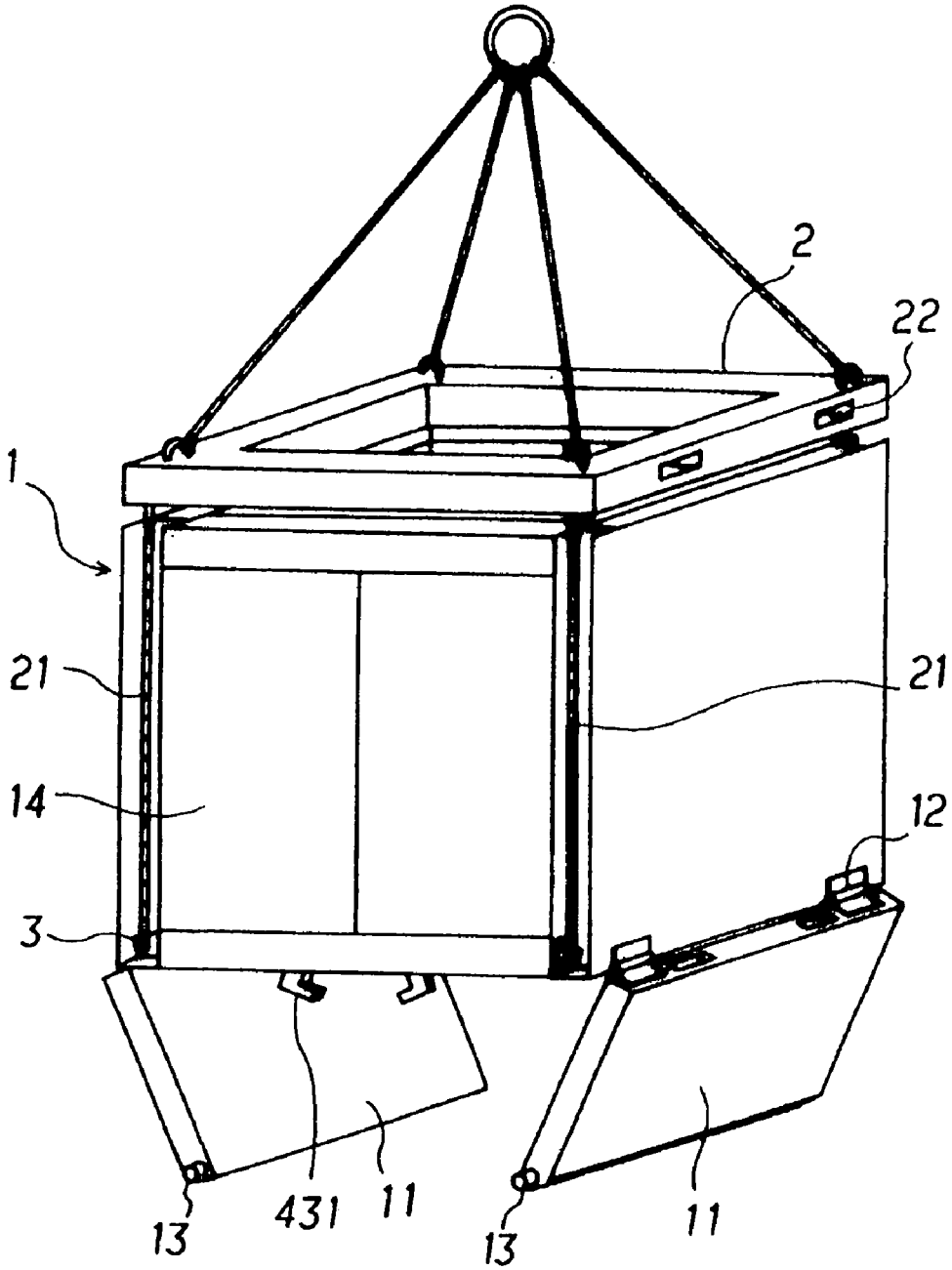
FIG. 15 is a perspective view illustrating a state that the bottom plates of the bottom opening type container are opened.
Figure 16:
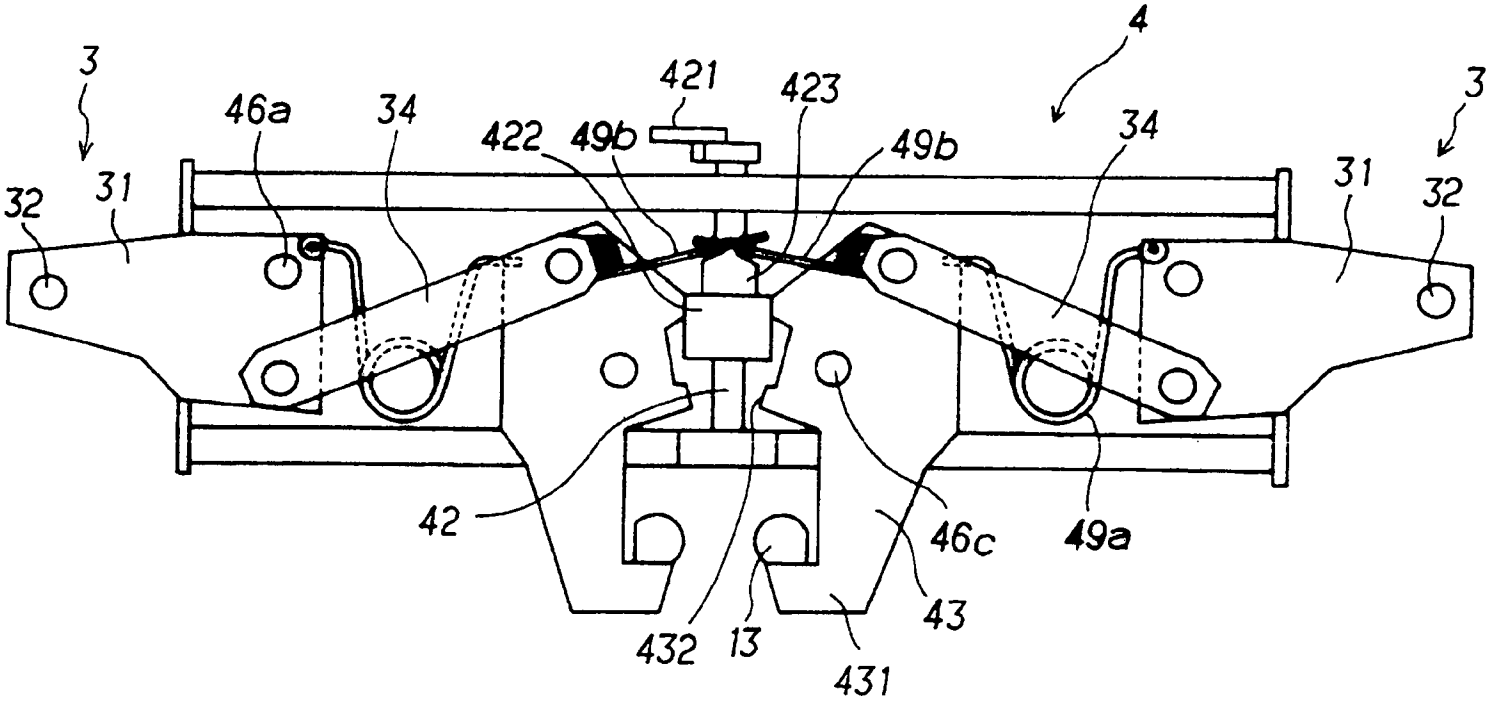
FIG. 16 is a partial front view illustrating an open/close control mechanism according to a conventional example.
Figure 17:
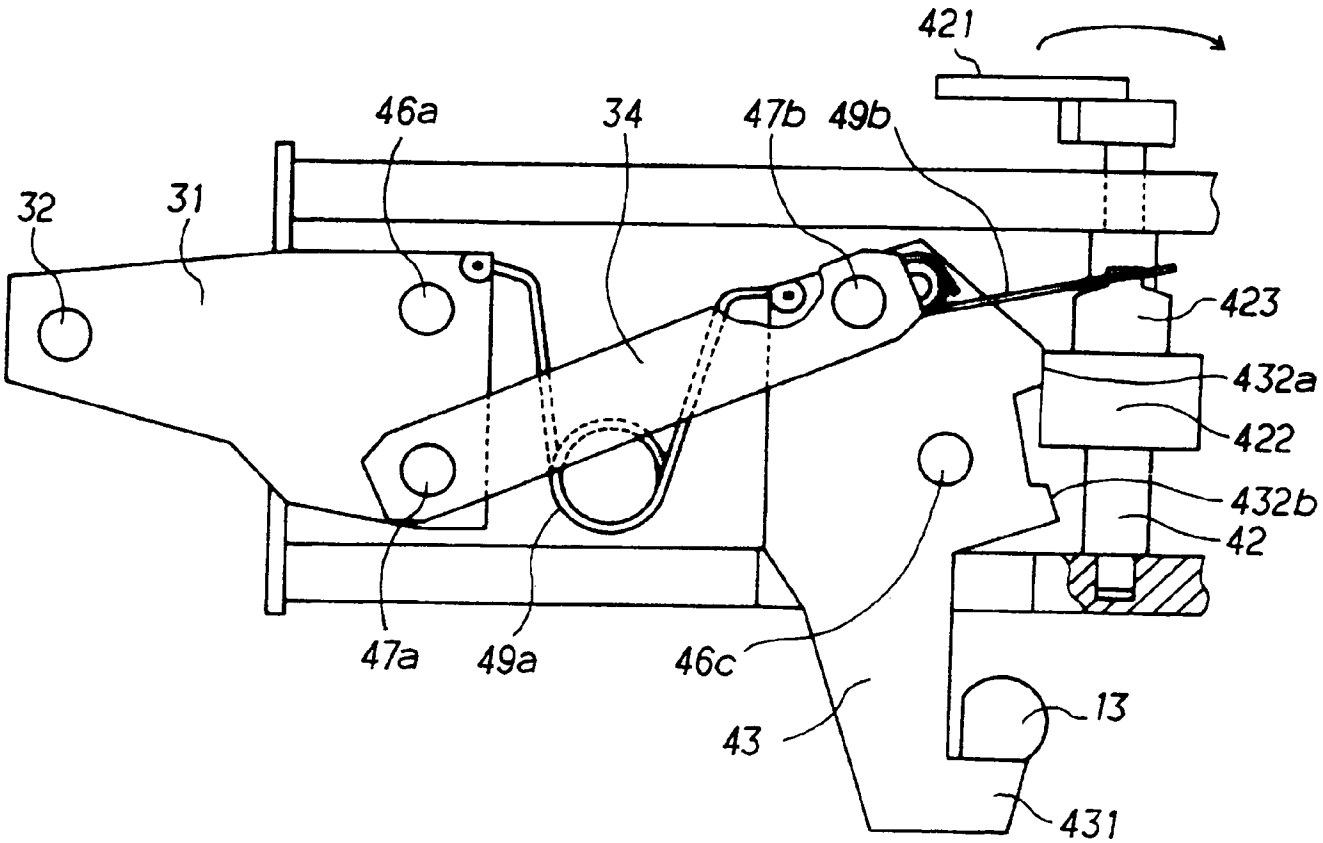
FIG. 17 is a partial front view illustrating the open/close control mechanism according to the conventional example.
Figure 18:
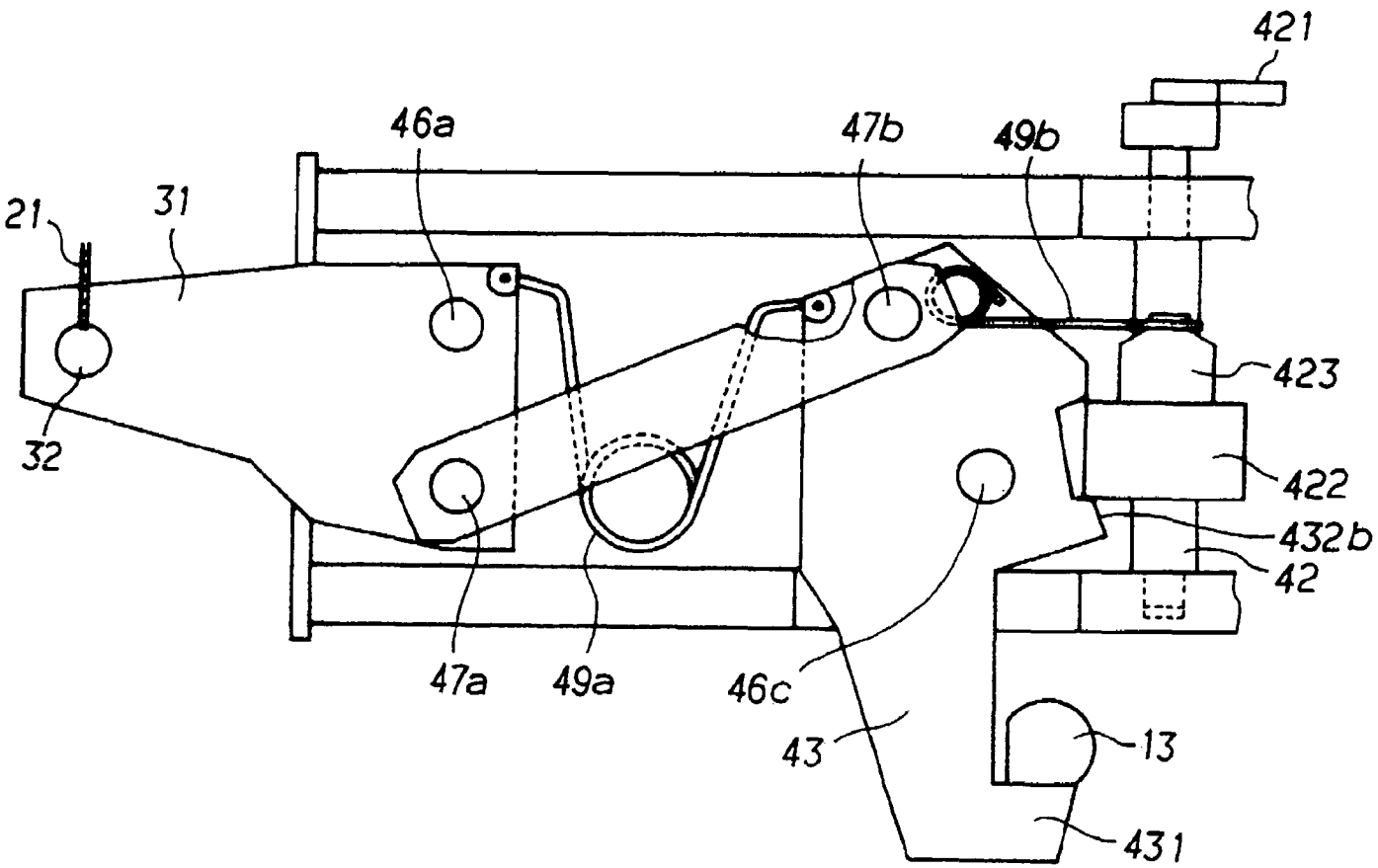
FIG. 18 is a partial front view illustrating the open/close control mechanism according to the conventional example.
Figure 19:
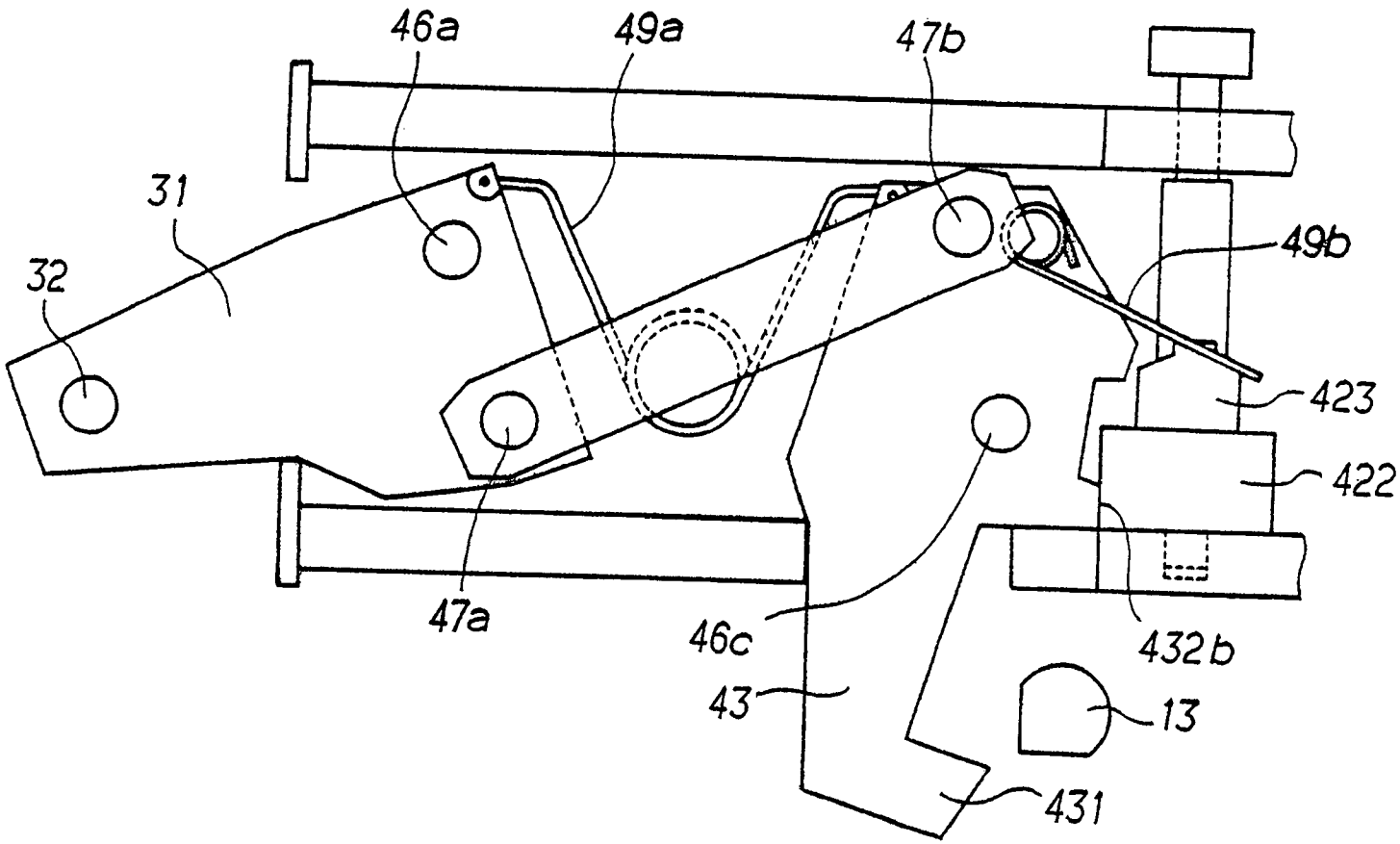
FIG. 19 is a partial front view illustrating the open/close control mechanism according to the conventional example.
Figure 20:
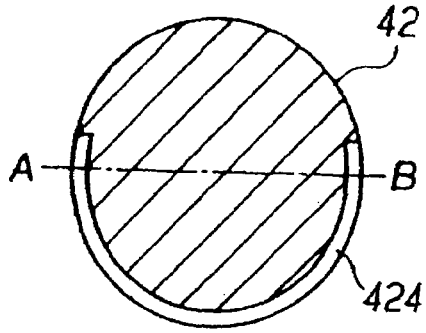
FIG. 20 is a sectional view illustrating a part of the open/close control mechanism according to the conventional example.
Figure 21:
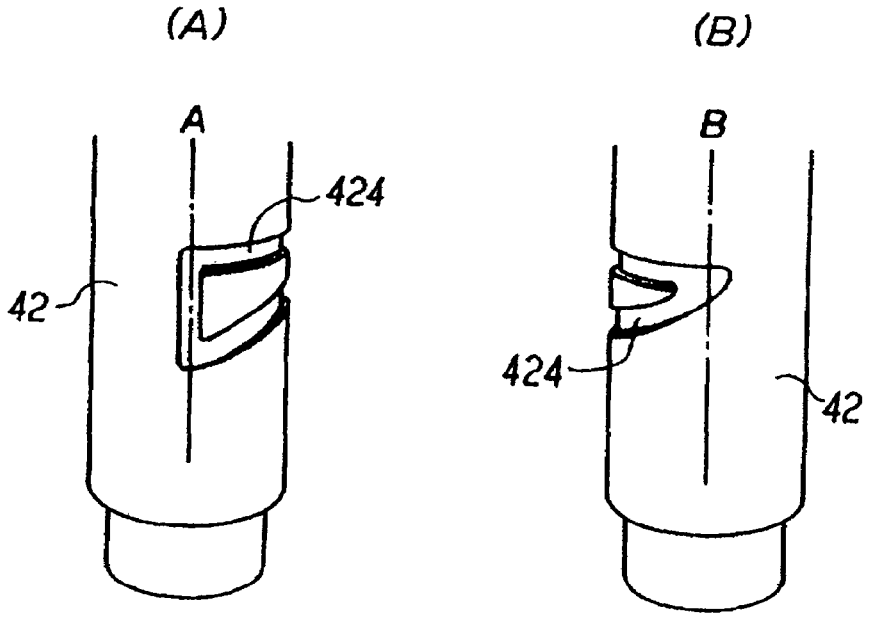
Prior Art Fig. 21
FIGS. 21A and 21B are perspective views illustrating apart of the open/close control mechanism according to the conventional example.

FIGS. 13A to 13C illustrate the above-described states of the container 1, FIG. 13A illustrates a standard state or a state that the container 1 is transported with the bottom plates 11 being closed, FIG. 13B illustrates a state that the container 1 is once landed in order to open the bottom plates 11 and the operation cam 41 is turned to the down posture and the hoisting wire rope W is loosened, and corresponds to FIG. 7 explained above. FIG. 13C illustrates a state that the container is again hoisted and the contents are discharged, and a state just after FIG. 8.

The preparing operation for discharging may be performed before the container reaches the discharge place. For example, after the operation cam is turned to the down posture, the container is transported, and reaches the destination, and is once landed and hoisted. As a result, the bottom plates are opened and the contents are discharged. In such a manner, the worker should not reach the container in order to open it in the discharge place, and thus the safety is further improved.

As mentioned above, when the container is in the basic state that the operation cam 41 is in the rise posture, the bottom plates 11 are not opened. Only when the container is once landed and the operation cam 41 is turned to the down position, and subsequently the container is again hoisted and landed, the bottom plates 11 are opened.

In order to discharge the contents from the container, all that is required is that the container is once landed and the operation cam is turned to the down position, and loose bulk materials can be loaded only by the hoisting and hoisting down operations using a crane. The operation cam may be operated on any sides of the container, and a visual check can be made clearly which posture the operation cam is in.

INDUSTRIAL APPLICABILITY

The bottom opening type container, in which the opening/closing of the bottom plates of the container is controlled by a secure operation, the state of the operation cam in the open/close control mechanism can be visually checked, and the operation cam can be handled only on one side of the container, is realized. As a result, the excellent effect such that the efficiency and the safety of the loading work are improved, is produced.

I claim:

1. A bottom opening type container composed of side plates and a pair of bottom plates, having hinges of the bottom plates attached to near bottom portions of the side plates, locking pins provided near distal ends of the bottom plates, and a pair of open/close arms which are pivotally supported around center portions thereof by fixed pins fixed to the side plates, and which interlock with each other via gear portions, and which are capable of locking the locking pins by lower end hook portions thereof, the container comprising an open/close control mechanism including:

hoisting plates supported pivotally about fixed pins fixed to upper portions of the side plates and having hoisting holes at outer ends thereof for connecting a wire rope to hoist the bottom opening type container;

a vertical link one end of which is connected to a hoisting plate and the other end of which is connected to an oscillating link swingably supported to a fixed pin fixed to a lower portion of a side plate;

a lateral link one end of which is connected to the oscillating link;

a link which is inserted into a hollowed out plate fixed to a lower portion of a side plate and one end of which is connected to the lateral link, and which is biased to one direction by a return spring; and an operation cam which has a rotating center thereof at a rear surface side of the open/close arms outside of the locking pins, and which restrains the rear surface of the open/close arms in a rise posture to maintain the open/close arms in a close state and releases the open/close arms in a down posture when the bottom plates are closed, wherein in a state that a distal end of the link or an extended portion attached to the distal end is placed on a stepped portion of the hollowed out plate or an upper end of the operation cam in a rise posture, one upper end of the open/close arms is restrained so that the open/close arms are maintained in a close state, wherein in a state that the distal end of the link or the extended portion attached to the distal end drops out of the stepped portion of the hollowed out plate or the upper end of the operation cam in the rise posture, one upper end of the open/close arms is released, and wherein the link moves to a horizontal direction interlocking with a movement of the hoisting plate, and a placed state is changed into a dropped state, so that the open/close arms are pressed to an open direction by a hoisting force.

2. The bottom opening type container according to claim 1, wherein the open/close control mechanism is provided to both sides viewed from the hinges of the bottom plates, and the respective operation cams are connected to each other via a connecting shaft.

* * * * *